United States Patent [19]

Yamazaki

[11] Patent Number: 4,968,991

[45] Date of Patent: Nov. 6, 1990

[54] MULTIBAND ANTENNA SYSTEM FOR USE IN MOTOR VEHICLES

[75] Inventor: Toru Yamazaki, Chiryu, Japan

[73] Assignee: Nippondenso Co., Ltd., Kariya, Japan

[21] Appl. No.: 212,221

[22] Filed: Jun. 27, 1988

[30] Foreign Application Priority Data

Jun. 27, 1987 [JP] Japan ..... 62-160563
Apr. 14, 1988 [JP] Japan ..... 63-92484

[51] Int. Cl.[5] ..... H01Q 1/32; H01Q 9/04

[52] U.S. Cl. ..... 343/715; 343/791; 343/853; 343/901; 343/905

[58] Field of Search ..... 343/713, 715, 790, 791, 343/792, 853, 901, 905, 852; 455/278, 283, 286, 288, 296, 297

[56] References Cited

U.S. PATENT DOCUMENTS

| | | | |
|---|---|---|---|
| 3,315,264 | 4/1967 | Brueckmann | 343/791 |
| 3,576,578 | 4/1971 | Harper | 343/791 |
| 3,879,735 | 4/1975 | Campbell et al. | 343/792 |
| 3,909,830 | 9/1975 | Campbell | 343/752 |
| 3,945,013 | 3/1976 | Brunner et al. | 343/791 |
| 4,095,229 | 6/1978 | Elliott | 343/715 |
| 4,313,121 | 1/1982 | Campbell et al. | 343/790 |
| 4,496,953 | 1/1985 | Spinks et al. | 343/792 |
| 4,647,941 | 3/1987 | Myer | 343/792 |
| 4,658,260 | 4/1987 | Myer | 343/792 |
| 4,675,687 | 6/1987 | Elliott | 343/715 |
| 4,725,846 | 2/1988 | Hendershot | 343/792 |
| 4,734,703 | 3/1988 | Nakase et al. | 343/750 |
| 4,748,450 | 5/1988 | Hines et al. | 343/791 |
| 4,764,773 | 8/1988 | Larsen et al. | 343/859 |

FOREIGN PATENT DOCUMENTS

| | | |
|---|---|---|
| 59-168702 | 9/1984 | Japan . |
| 61-46601 | 3/1986 | Japan . |
| 61-227405 | 10/1986 | Japan . |

*Primary Examiner*—Michael C. Wimer
*Attorney, Agent, or Firm*—Cushman, Darby & Cushman

[57] ABSTRACT

A multiband antenna system for use in a motor vehicle, which includes a one-unit antenna section coupled to a transceiver for transmission and reception of a signal with a frequency in a first frequency band and a receiver for reception of a signal with a frequency in a second frequency band. The antenna section, being provided so as to be protruded upwardly from the motor vehicle, comprises a first antenna element adapted to operate with respect to the first frequency band and a second antenna element adapted to operate with respect to the second frequency band different from the first frequency band. The second antenna element is made up of a conductor tube which is in turn introduced into the motor vehicle and further extends up to the transceiver. A center conductor line is coaxially encased in the conductor tube so as to make up a coaxial line, one end of which is connected to the first antenna element and the other end of which is coupled to the transceiver. Also included in the system is a connector which performs coupling between the conductor tube and the receiver. Between the connector and the transceiver is provided a noise-reduction device which has a high inductance so as to cut off noises led to the coaxial line and introduced through the connector into said receiver.

5 Claims, 9 Drawing Sheets

BEFORE PROVISION OF INDUCTOR

AFTER PROVISION OF INDUCTOR

MULTIBAND ANTENNA SYSTEM FOR USE IN MOTOR VEHICLES

BACKGROUND OF THE INVENTION

The present invention relates generally to a multiband antenna system for use in a motor vehicle, and more particularly to a one-unit multiband antenna unit suitable for use on a motor vehicle and effective for reception of AM/FM radio signals and further for quasi-microwave communication, for example.

Recently, various types of multiband antenna units adapted for reception of AM/FM radio signals and further transmission and reception of a high frequency band over UHF and suitable for use on motor vehicles have been proposed, such as is disclosed in Japanese Patent provisional Publication No. 61-46601 or 61-227405. These antennae are made such that the antenna unit comprises an elongated inner conductor and an elongated cylindrical outer conductor which are coaxially arranged with each other so as to form a coaxial line. One end of the inner conductor is connected to a quasi-microwave communication antenna element and the other end of the inner conductor and one end of the outer conductor are coupled to a quasi-microwave transceiver mounted on the motor vehicle. A portion of the outer conductor (in the case of the Japanese Patent Provisional Publication No. 61-227405, a conductor tube additionally provided to coaxially encase the outer conductor) is further coupled to an AM/FM receiver which is further coupled to a portion of the vehicle metallic body. However, the motor vehicle has many noise sources such as ignition system, and therefore an important problem encountered in such multiband antennas relates to introduction of noises through the output conductor and so on into the AM/FM receiver, which in turn results in the mutual intervention between the AM/FM reception and the quasi-microwave communication.

SUMMARY OF THE INVENTION

It is therefore an object of the present invention to provide a multiband antenna unit which is capable of preventing the noise generated in a vehicle from being introduced through coaxial transmission of radio transceiver equipment line into radio receiver equipment, for example, an AM/FM receiver.

A multiband antenna system for use in a motor vehicle according to the present invention includes a one-unit antenna section coupled to a transceiver for transmission and reception of a signal with a frequency in a first frequency band and a receiver for reception of a signal with a frequency in a second frequency band. The antenna section, being provided so as to be protruded upwardly from the motor vehicle, comprises a first antenna element adapted to operate with respect to the first frequency band and a second antenna element adapted to operate with respect to the second frequency band different from the first frequency band. The second antenna element is made up of a conductor tube which is in turn introduced into the motor vehicle and further extends up to the transceiver and a center conductor line is coaxially encased in the conductor tube so as to make up a coaxial line, one end of the center conductor line being connected to the first antenna element and the other end thereof being coupled to the transceiver. Here, it is also appropriate that the second antenna element is made up of metallic tubes and a coaxial line comprising a center conductor line and an outer conductor tube is at one end coupled to the first antenna element and coupled at the other end to the transceiver. Also included in the system is a connector which performs coupling between the conductor tube or the metallic tubes and the receiver. One of the most important features of this invention is that a noise-reduction means which has a high inductance so as to reduce noise induced on an outer surface of an outer conductor of the coaxial line and introduced through the connector into the receiver. The noise reduction means is provided for the coaxial transmission line between the connector and the receiver. The noise-reduction means is constructed by partially coiling the coaxial line therebetween. Preferably, the noise-reduction means is constructed by successively winding the coaxial line around a cylindrical magnetic member by a predetermined turn number so that the wound portion of the coaxial line is arranged to form a ring-like configuration, constructed by successively winding the coaxial line around a rod-like magnetic member by a predetermined turn number or constructed by successively winding magnetic members around the coaxial line.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
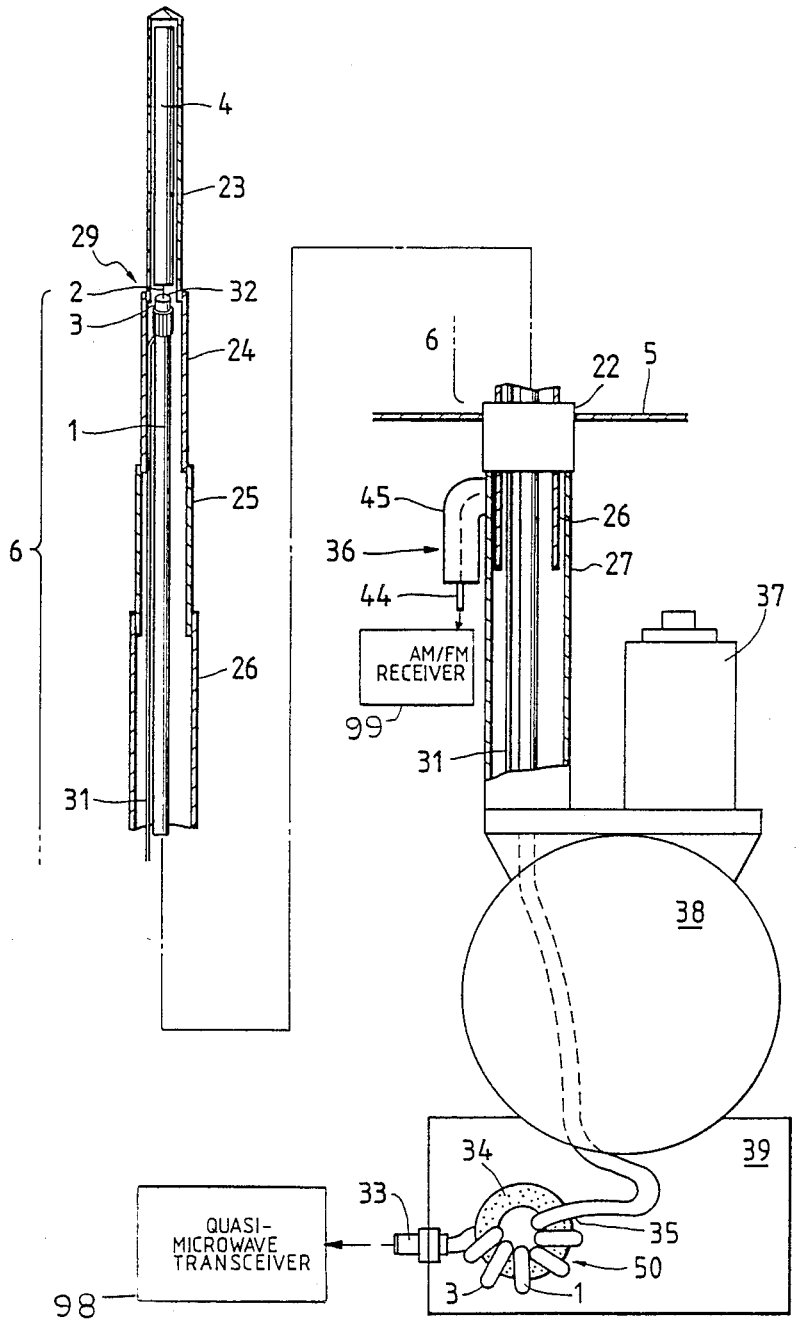
FIG. 1 shows an arrangement of a multiband antenna system according to an embodiment of the present invention.

Referring now to FIG. 1, there is illustrated an arrangement of a multiband antenna unit according to an embodiment of the present invention which is operatively coupled to an antenna drive motor 37 so as to allow the elevating operation of both the quasi-microwave communication antenna section and the AM/FM reception antenna section. In FIG. 1, the multiband antenna unit includes an AM/FM antenna section 6 which is inserted into a hole defined in an antenna mounting portion 22 of a body 5 of the motor vehicle and then fixedly secured thereat by means of an appropriate fixing means so as to be insulated from the vehicle body 5. The AM/FM antenna section 6 includes cylindrical metallic tubes 24, 25 and 26 each of which are made of an appropriate metal and which are telescopically arranged stepwise so as to allow expansion and shrinking of the entire length thereof upwardly and downwardly with respect to the body 5 of the motor vehicle. That is, the AM/FM antenna section 6 is of a multi-stage sleeve construction. Under the antenna mounting portion 22 and in the motor vehicle is provided an encasing pipe 27, into which the collapsed AM/FM antenna section 6 can be wholly encased. Here, the entire length of the AM/FM antenna section 6 in the fully-expanded state is about 800 to 900 mm, for example. Also included in the multiband antenna unit is a quasi-microwave antenna section 4 for quasi-microwave (about 700 MHz to 3GHz, for example) communication which is made of an appropriate metal and which is mounted on the top end portion 29 of the AM/FM antenna section 6, i.e., one end portion of the cylindrical tube 24, with it being encased into a resin tube 23, that is, with the outer surface of the quasi-microwave antenna section 4 being covered thereby. The quasi-microwave antenna section 5 has a length of about 90 mm, for example, and are adapted to be stored into the AM/FM antenna section 6 and further into the encasing pipe 27. Here, it is also appropriate that the quasi-microwave antenna section 4 is constructed as a known collinear two-stage array antenna.

The AM/FM antenna section 6 has therein a coaxial line 1 for power supply, one end portion 32 of which is coupled to the lower end portion of the quasi-microwave antenna section 4 and the other end of which is introduced through the inside of the AM/FM antenna section 6 into the motor vehicle and therein coupled to a coaxial connector 33. The coaxial line comprises a center conductor portion 2 and an outer conductor portion 3 provided round the center conductor portion 2. On the way to the coaxial connector 33, the coaxial line 1 is toroidally wound around a core 34, which is made of a magnetic material such as ferrite, so as to form a noise-reduction means (which will hereinafter be referred to as inductor) 50 to have a high inductance. Here, the length of the coaxial line (first portion) 1 between an AM/FM connector 36 (in this case for the AM/FM radio signal reception) and the inductor 50 may be determined so as to satisfy the FM band matching condition with respect to the AM/FM connector 36. That is, the length thereof is determined in consideration of the impedance matching in order for no absorption of the FM band reception signal by the above-mentioned first portion. The other parameters to determine the matching condition are the material of the core toroidal 34, the way of winding of the coaxial line 1 around the toroidal core 34, and the number of the coaxial line 1. In other words, the deterioration of the AM/FM sensitivity can be prevented by determining the length between the AM/FM connector 36 and the inductor 50 so that, as shown in FIG. 3, the resonance point P is present in a predetermined frequency range in the FM band.

Figure 3:
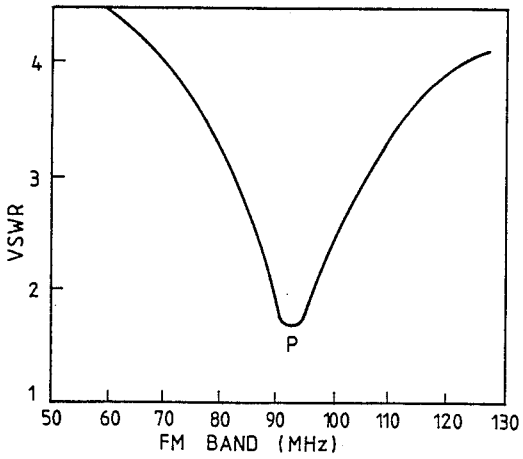
FIG. 3 is a graphic illustration for describing the FM band matching condition.

In FIG. 3, the vertical axis represents the voltage standing wave ratio (VSWR) and the horizontal axis represents the frequency in the FM band. The AM/FM connector includes a conductive outer portion 45 and a center conductor portion 44 covered thereby, one end portion of the center conductor portion 44 being connected to the metallic tube portion 26 and the other end portion thereof being coupled to a signal-carrying line which in turn extends toward an AM/FM receiver 99.

The coaxial connector 33 is coupled to one end of an external coaxial line 1, the other end of which is in turn coupled to a quasi-microwave transceiver 98. If required, the ground, i.e., coupling to the body 5 of the motor vehicle, of the outer conductor portion 3 may be effected at a portion of the coaxial line 1 between the inductor 50 and the quasi-microwave transceiver. Furthermore, for the expansion and retraction of the antenna, there is provided a wire 31 which is fixedly secured to the coaxial line 1. As well as a known electric antenna, the wire 31 is arranged to be taken up around a drum or the like in a wire storing section 38 and drawn out therefrom by means of a drive motor 37 so as to perform the expansion and retraction of the AM/FM antenna section 6. In response to the expansion and retraction thereof, the coaxial line 1 is similarly accommodated and taken out in and from a coaxial-line storing section 39 which may be positioned under the wire storing section 38.

Figure 2A:
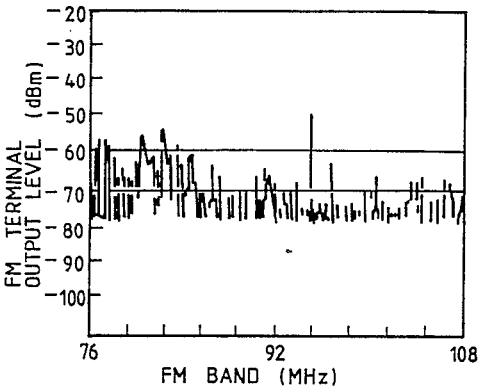
FIGS. 2A and 2B show noise, levels before and after provision of an inductor.
Figure 2B:
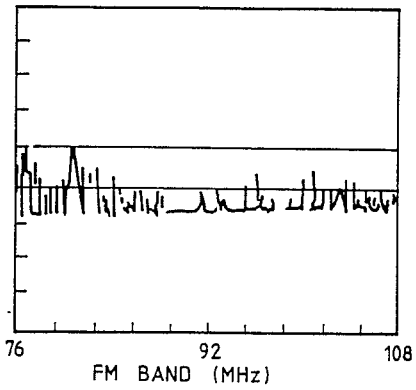

With the above-described arrangment of the multiband antenna unit in which the ferrite core 34 makes up the inductor 50 with respect to the outer conductor portion 3 of the coaxial line 1, the noise current induced on surface of the outer the outer conductor portion 3 of the coaxial line 1 coupled to the quasi-microwave antenna section 4 is shut off by using the inductor 50 to considerably reduce the introduction of the noises into the AM/FM receiver, not shown, without lowering the sensitivity of the quasi-microwave antenna section 4, as shown in FIGS. 2A and 2B, FIG. 2A showing the noise level before the provision of the inductor 50 and FIG. 2B illustrating the noise level after the provision of the inductor 50.

That is, the communication signal for the quasi-microwave antenna section 4 is expressed as a pair of mutually reverse high-frequency currents propagated between the center conductor portion 2 and the inner surface of outer conductor portion 3, and therefore the magnetic fields produced by the currents are cancelled with each other. The inductor made up by the ferrite toroidal core 34 or the turns of the coaxial line 1 does not affect the transmission of the quasi-microwave signal, resulting in no deterioration of the antenna sensitivity.

Figure 4:
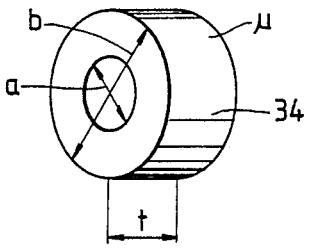
FIG. 4 is a perspective view showing a magnetic core used in the inductor.

A description in terms of the characteristics of the inductor 50 made up of the ferrite core 34 will hereinbelow be made in detail. FIG. 4 is a perspective view of the ferrite core 34 which has a cylindrical configuration. In the case of the cylindrically shaped ferrite core 34, the AL value can be obtained in accordance with the following equation:

$$AL=(\tfrac{1}{2}\pi)\cdot\mu\cdot t\cdot\ln(b/a) \quad (1)$$

where AL is a constant value used to determine the inductance of an inductor having magnetic permeability and dimensions of a core $\mu$ represents the magnetic permeability depending upon the material of the core 34, t designates the thickness of the core 34, b is the outer diameter of the core 34, a is the inner diameter of the core 34, and ln represents log e.

Figure 5:
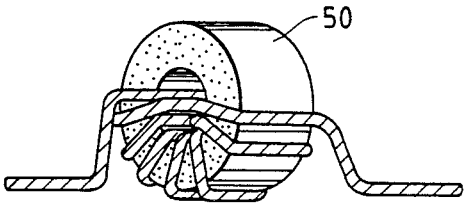
FIG. 5 is a perspective view showing one example of the inductor.

FIG. 5 is an illustration of the core 34 with a winding therearound. The inductance L of the core with the winding can be expressed by the following equation:

$$L=AL\cdot N^2 (L\propto AL, \text{ therefore, } L\propto\mu) \quad (2)$$

where N represents the number of turns of the winding. Here, the AL value depends upon the configuration and material of the core 34 and the formation of core 34 is not limited to the cylindrical configuration.

Figure 6:
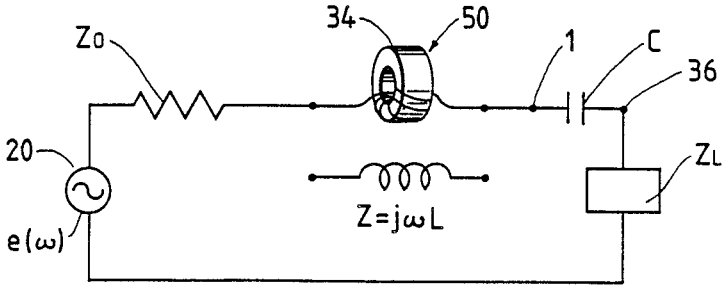
FIG. 6 is an illustration of an equivalent circuit corresponding to the arrangement of FIG. 1.

FIG. 6 shows an equivalent circuit illustration for describing the relation among the inductor 50, the AM/FM side terminal 36 and a noise source 20 designated by reference e($\omega$). In the drawing, reference C represents the coupling capacity between the outer conductor portion 3 of the coaxial line 1 and the metallic tube portions 24, 25, 26 of the AM/FM antenna section 6. With respect to the noise cut-off characteristic, the attenuation value, which is a ratio of the noise produced $\beta$ voltage at ZL before inductance equipped to that after inductance equipped can be expressed in accordance with the following equation:

$$\beta = 20\log_{10}\left|\frac{(Zo+Z_L)j\omega C+1}{(Zo+Z_L)j\omega C+1-\omega^2 LC}\right|(dB) \quad (3)$$

where Zo represents the impedance of the noise source 20, L designates the inductance of the core 34, C depicts the coupling capacity, and $Z_L$ is the AM/FM side input impedance.

Thus, it will be understood from the above equation that the attenuation is increased as the inductance L becomes greater. Although $L\propto\mu$, the magnetic permeability $\mu$ is a complex magnetic permeability $\mu^*$ in a high-frequency band and $\mu^*=\mu r^*\cdot\mu o$ where $\mu r^*$ represents a complex relative magnetic permeability which depends upon the material, $\mu o$ designates a magnetic permeability in the vacuum condition. The complex relative magnetic permeability $\mu r^*$ has the relation of $\mu r^*=\mu r'-j\mu r''$ with respect to the real part $\mu r'$ and the imaginary part $\mu r''$, where $\mu r''$ represents a loss item. Here, it is appropriate to select a material whose $\mu r''$ is large.

Figure 7:
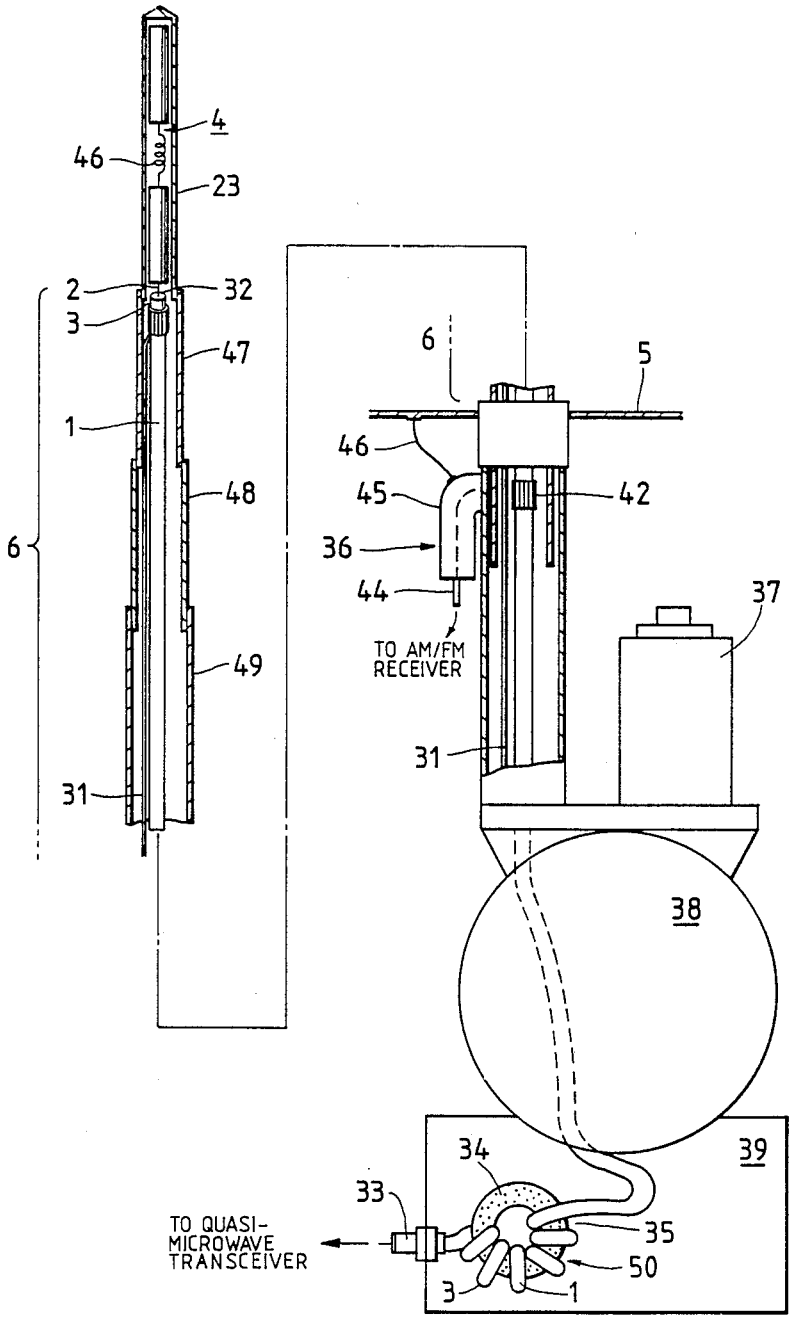
FIG. 7 is an illustration for describing another arrangement of the multiband antenna system according to this invention.

FIG. 7 shows another arrangement of the multiband antenna unit in which parts corresponding to those in FIG. 1 are marked with the same numerals and the description thereof will be omitted for brevity. Here, the quasi-microwave antenna section 4 is constructed as a collinear 2-stage array antenna and or sleeve antenna has a phase coil 46 which is coupled to the center conductor portion 2 of the coaxial line 1. A difference between the multiband antenna units of FIGS. 1 and 7 is that the center conductor portion 44 of the AM/FM connector 36 is connected to the outer conductor portion 3 of the coaxial line 1 through a coupling device 42 which is arranged to be in slidable connection with the outer conductor portion 3 thereof and the outer conductor portion 45 is coupled through a lead wire 46 to the body 5 of the motor vehicle. Thus, the AM/FM antenna section 6 comprises cylindrical resin tubes 47, 48 and 49, in place of the metallic tubes 24 to 26 of FIG. 1, which can similarly be expanded and retracted means of the drive motor 37.

Figure 8:
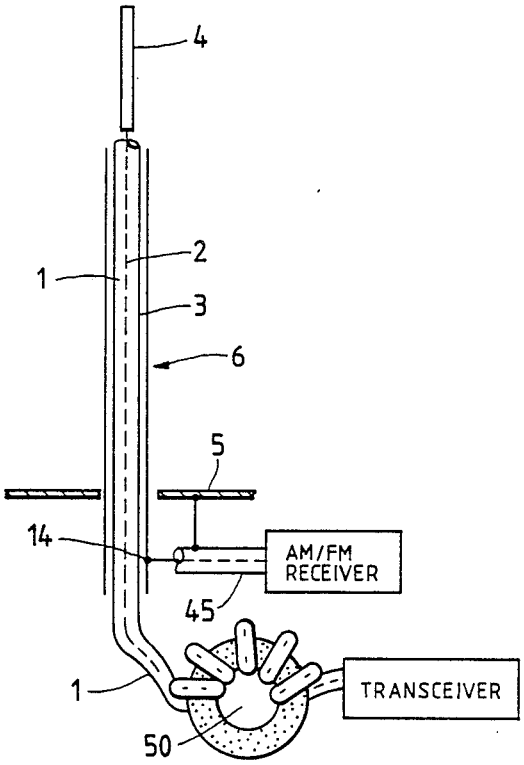
FIG. 8 is a schematical illustration for additionally describing the embodiment of this invention which includes the arrangement of the inductor illustrated in FIG. 5.
Figure 9:
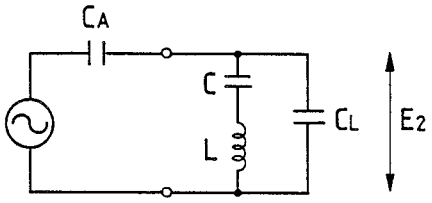
FIG. 9 is an illustration of an equivalent circuit corresponding to the FIG. 8 arrangement.
Figure 10:
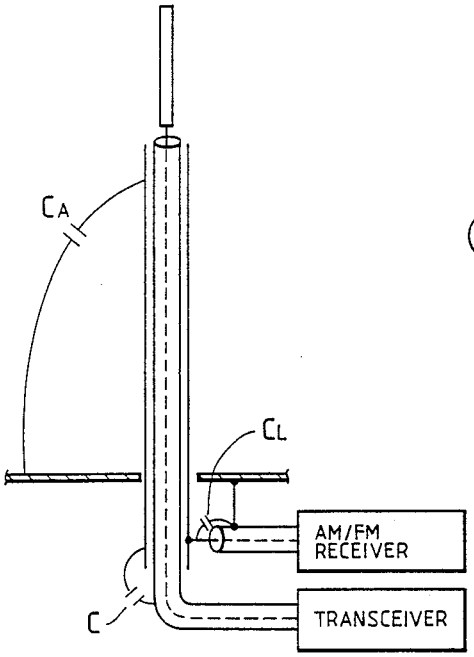
FIG. 10 PRIOR ART
FIG. 10 shows one example of the arrangement of a conventional multiband antenna unit which does not include an inductor.
Figure 11:
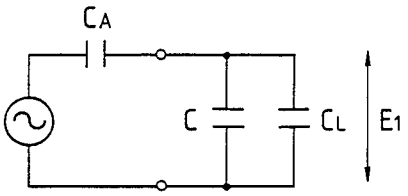
FIG. 11 is an illustration of an equivalent circuit corresponding to the conventional multiband antenna illustrated in FIG. 10.
Figure 12:
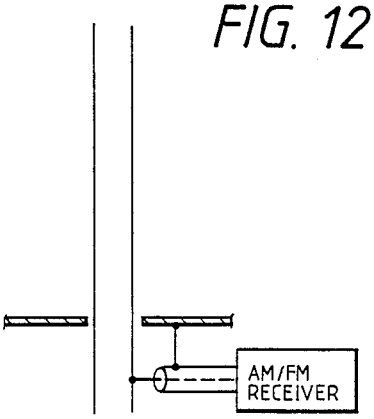
FIG. 12 PRIOR ART
FIG. 12 shows another example of the arrangement of a conventional multiband antennal unit which does not include an inductor and a coaxial transmission line.
Figure 13:
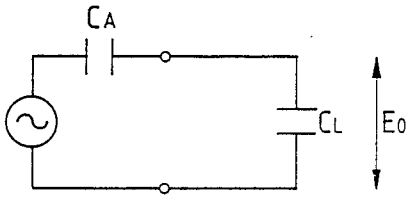
FIG. 13 PRIOR ART
FIG. 13 illustrates an equivalent circuit of the FIG. 12 arrangement.

FIG. 8 is a schematic illustration for additionally describing the embodiment of this invention in terms of improvement of the AM sensitivity and the FM sensitivity. FIG. 9 shows an equivalent circuit corresponding to the arrangement of FIG. 8. The description will be made with reference to FIGS. 10, 11, 12 and 13 for a better understanding of this embodiment, FIG. 10 showing one example of the arrangement of a multiband antenna unit which does not include the inductor 50, FIG. 11 showing the equivalent circuit corresponding to the FIG. 10 arrangement, FIG. 12 illustrating another example of the arrangement of a multiband antenna unit which does not include the inductor 50 and the coaxial line 1, and FIG. 13 illustrating the equivalent circuit corresponding to the FIG. 12 arrangement. The relative relation in sensitivity among the FIGS. 8, 10 and 12 arrangements can be expressed in accordance with the following equations in which reference E0 represents the sensitivity of the FIG. 12 arrangement, E1 designates the sensitivity of the FIG. 10 arrangement, and E2 depicts the sensitivity of the FIG. 8 arrangement.

$$r1 = 20\log_{10}\left|\frac{E1}{Eo}\right| = \frac{CA+CL}{CA+CL+C}(dB) \quad (4)$$

$$r2 = 20\log_{10}\left|\frac{E2}{Eo}\right| = \left|\frac{CA+CL}{CA+CL+\dfrac{C}{1-\omega^2 LC}}\right|(dB) \quad (5)$$

where:

r1 represents the relative sensitivity of the FIG. 10 arrangement with respect to the sensitivity of the FIG. 12 arrangement;

r2 designates the relative sensitivity of the FIG. 8 arrangement with respect to the sensitivity of the FIG. 12 arrangement;

CA depicts the antenna capacity (AM/FM antenna capacity) in the case of the FIG. 12 arrangement;

CL is the load capacity;

C is the coupling capacity between the AM/FM metallic tube and the outer conductor of the coaxial line; and L is the inductance of the inductor 50 in FIG. 8.

As clearly understood from the above-mentioned equation (4), the sensitivity is deteriorated in accordance with the magnitude of C. However, in the case of the provision of the inductor 50, the relative sensitivity can be improved under the condition of satisfying the following equation (6):

$$1-\omega^2 LC<0 \quad (6)$$

where $\omega=2\pi f$ and f represents the AM frequency band.

Figure 14:
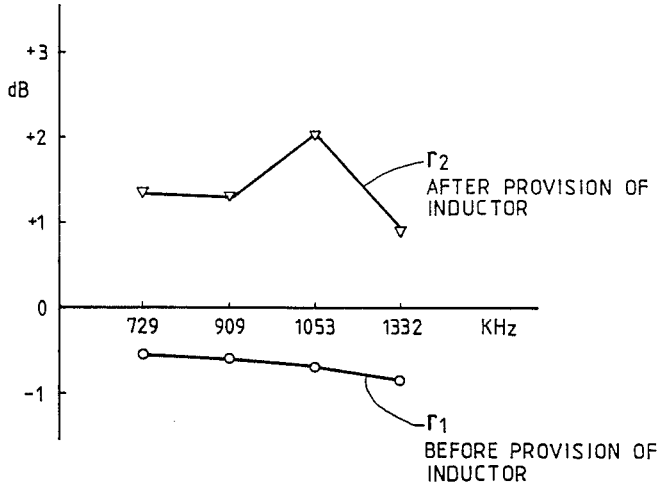
FIG. 14 is a graphic illustration for describing the sensitivities before and after provision of the inductor.

FIG. 14 is a graphic illustration showing the sensitivity characteristics with respect to the frequencies in which r2 is the relative sensitivity in the case of the provision of the inductor 50 whose inductance L is adjusted and r1 is the relative sensitivity of FIG. 10 arrangement which does not has the inductor 50.

Figure 15A:
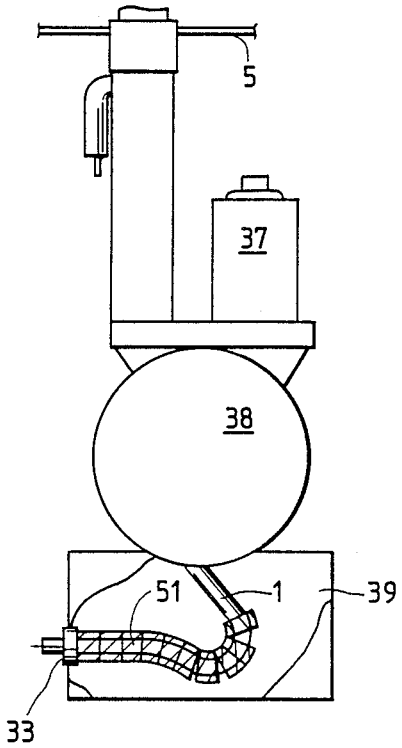
FIGS. 15A, 15B show further arrangements of the inductor used in the multiband antenna systems according to this invention.
Figure 15B:
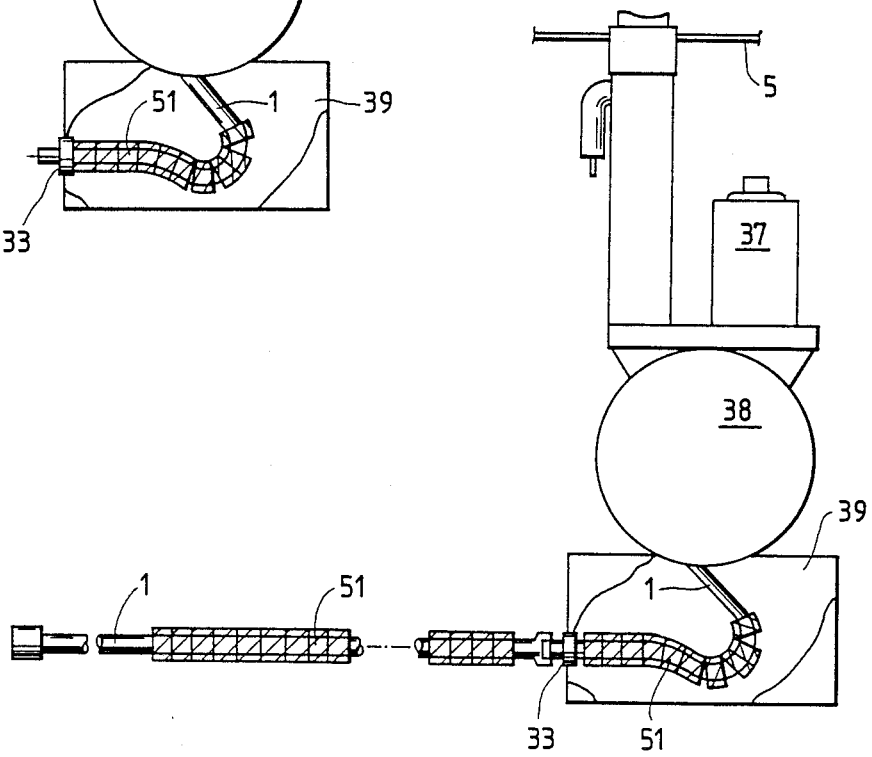

FIGS. 15A and 15B show modifications of the embodiment of this invention. An important point herein is that the inductor 50 is arranged by inserting the coaxial line 1 into magnetic, i.e., ferrite, beads 51. This arrangement also provides the same effect as the above-mentioned arrangement of the inductor 50 in FIGS. 1 and 7. In the case of the FIG. 15B arrangement, the magnetic beads 51 are additionally provided around the coaxial line 1 between the connector 33 and the quasi-microwave transceiver, not shown, thereby further improving the noise reduction.

Figure 16:
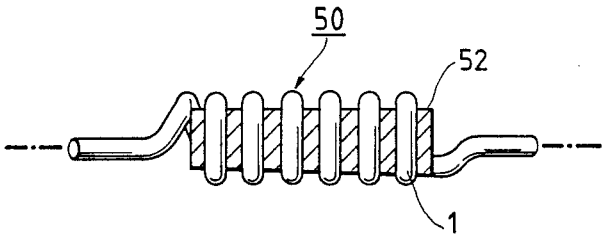
FIGS. 16 and 17 are illustrations of still further arrangements of the inductor.
Figure 17:
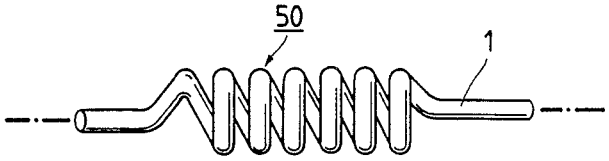

FIGS. 16 and 17 show further modifications of the above-mentioned inductor 50 in the embodiment of this invention. In the case of the FIG. 16 arrangement, the coaxial line 1 is wound around a rod-like ferrite core 52 so as to form a coil-like configuration. On the other hand, in the case of the FIG. 17 arrangement, the coaxial line 1 is partially turned so as to form a coil-like configuration. These arrangements provide the same effect as the FIG. 1 arrangement.

It should be understood that the foregoing relates to only preferred embodiments of the present invention, and that it is intended to cover all changes and modifications of the embodiments of this invention herein used for the purposes of the disclosure, which do not constitute departures from the spirit and scope of this invention. For example, although in the above description the core 34 is made of the ferrite, it is also appropriate that the core 34 is made of other materials such as amolphous and iron each of which has a high magnetic permeability and whose high-frequency loss is large.

What is claimed is:

1. A multiband antenna system for use in a motor vehicle, comprising:

transceiver means for transmitting and receiving a signal with a frequency in a first frequency band;

receiver means for receiving a signal with a frequency in a second frequency band;

an antenna section provided at the outside of said motor vehicle so as to protrude upwardly from said motor vehicle, said antenna section including a first antenna element tuned to the frequency in said first frequency band and a second antenna element tuned to the frequency in said second frequency band different form said first frequency band, said first antenna element being provided on said second antenna element so that said antenna section is of a one-unit construction, said second antenna element comprising metallic tube means;

a coaxial transmission line comprising a center conductor and a conductor tube, said center conductor being coaxially encased in said conductor tube, one end portion of said coaxial transmission line being coupled to said first antenna element and the other end portion thereof being introduced through an inside of said metallic tube means into said motor vehicle and coupled to said transceiver means;

connector means connected to a portion of the metallic tube means so as to perform coupling between said metallic tube means and said receiver means; and noise-reduction means having a high inductance and forming a portion of said coaxial transmission line provided at a portion of said coaxial transmission line between said connector means and said transceiver means so as to reduce noise led to said coaxial transmission line and introduced through said connector means into said receiver means, said noise-reduction means being constructed by partially coiling at least a part of said portion of said coaxial transmission line and arranged to satisfy the following equation:

$$1-(2\pi f)^2 \cdot L \cdot C < O$$

where L represents an inductance of said noise-reduction means, C is a coupling capacity between said metallic tube means of said second antenna element and said conductor tube of said coaxial line, and f is a frequency band received by said receiver means.

2. A multiband antenna system as claimed in claim 1, further comprising a cylindrical magnetic member, wherein said noise-reduction means is constructed by successively winding said coaxial transmission line around said cylindrical magnetic member by a predetermined number of turns so that the wound portion of said coaxial transmission line is arranged to form a ring-like configuration.

3. A multiband antenna system as claimed in claim 1, further comprising a rod-like magnetic member, wherein said noise-reduction means is constructed by successively winding said coaxial transmission line around said rod-like magnetic member by a predetermined number of turns.

4. A multiband antenna system as claimed in claim 1, wherein said noise-reduction means is constructed by successively winding magnetic members around said coaxial line.

5. A multiband antenna system for use in a motor vehicle, comprising:

transceiver means for transmitting and receiving a signal with a frequency in a first frequency band;

receiver means for receiving a signal with a frequency in a second frequency band;

an antenna section including first and second antenna elements, said first antenna element being of a non-grounded type and provided on said second antenna element so that said antenna section is of a one-unit construction, said second antenna element comprising metallic tube means, said first antenna element being tuned to the frequency in said first frequency band and said second antenna element being tuned to the frequency in said second frequency band different from said first frequency band;

a coaxial line comprising a center conductor line and a conductor tube, said center conductor line being coaxially encase in said conductor tube and said conductor tube being insulated from said metallic tube means, an upper end portion of said coaxial line being coupled to said first antenna element so as to couple the signal with the frequency in said first frequency band between the upper end portion of said coaxial line and an upper end portion of said center conductor line, said coaxial line acting as a coaxial transmission feed line for said first frequency band and being introduced through the inside of said metallic tube means into said motor vehicle so as to be insulated from said metallic tube means and extending to said transceiver means;

connector means holding a coaxial transmission feed line which extends to said receiver means provided in said motor vehicle and coupled to a portion of said metallic tube means existing at least within the body of said motor vehicle so that the signal with the frequency in said second frequency band is coupled between a center of said coaxial transmission feed line for said second frequency band and an outer conductive portion of said coaxial transmission feed line therefor; and noise-reduction means having a high inductance and made up at a portion of the outer surface of said conductor tube which is between said connector means and said transceiver means and near said conductor means so as to cut off noise generated in the vehicle and induced on the outer surface of said conductor tube from said connector means, said noise-reduction means being constructed by partially winding the conductor tube so as to form a coil and to satisfy the following equation:

$$1-(2\pi f)^2 \cdot L \cdot C < O$$

where L represents an inductance of said noise-reduction means, C is a coupling capacity between said metallic tube means of said second antenna element and said conductor tube of said coaxial line, and f is a frequency band received by said receiver means.

* * * * *